US008622320B2

(12) United States Patent
Plantz et al.

(10) Patent No.: US 8,622,320 B2
(45) Date of Patent: Jan. 7, 2014

(54) SPRAYER

(75) Inventors: Jeffrey Plantz, Clinton, NY (US); Mario Restive, Frankfort, NY (US)

(73) Assignee: The Fountainhead Group, Inc., New York Mills, NY (US)

( * ) Notice: Subject to any disclaimer, the term of this patent is extended or adjusted under 35 U.S.C. 154(b) by 787 days.

(21) Appl. No.: 12/206,973

(22) Filed: Sep. 9, 2008

(65) Prior Publication Data

US 2010/0059605 A1 Mar. 11, 2010

(51) Int. Cl.

| | |
|---|---|
| ***A62C 5/02*** | (2006.01) |
| ***A62C 13/62*** | (2006.01) |
| ***A62C 13/66*** | (2006.01) |
| ***A62C 35/58*** | (2006.01) |
| ***B05B 9/03*** | (2006.01) |

(52) U.S. Cl.

USPC ..... 239/310; 239/302; 239/317; 239/375

(58) Field of Classification Search

USPC ..... 239/318, 142, 394, 396, 436, 302, 310, 239/317, 337, 338, 340, 342, 353, 354, 364, 239/367, 373, 375, 391, 392, 397, 407, 433, 239/437; 222/331, 335, 400.7

See application file for complete search history.

(56) References Cited

U.S. PATENT DOCUMENTS

| | | | | |
|---|---|---|---|---|
| 3,655,096 | A * | 4/1972 | Easter | 222/82 |
| 4,475,689 | A * | 10/1984 | Hauger et al. | 239/318 |
| 4,901,923 | A * | 2/1990 | McRoskey et al. | 239/123 |
| 6,003,787 | A | 12/1999 | Fisher | |
| 6,158,673 | A * | 12/2000 | Toetschinger et al. | 239/305 |
| 6,293,294 | B1 * | 9/2001 | Loeb et al. | 137/1 |
| 6,869,028 | B2 * | 3/2005 | Bartsch et al. | 239/315 |
| 7,073,734 | B2 * | 7/2006 | Dorendorf et al. | 239/398 |
| 7,407,117 | B2 * | 8/2008 | Dodd | 239/310 |
| 2002/0117558 | A1 | 8/2002 | Timmes et al. | |
| 2005/0284960 | A1 | 12/2005 | Arevalo et al. | |

FOREIGN PATENT DOCUMENTS

| | | |
|---|---|---|
| JP | 55056857 | 4/1980 |

* cited by examiner

*Primary Examiner* — Justin Jonaitis

(74) *Attorney, Agent, or Firm* — George R. McGuire; Bond Schoeneck & King, PLLC

(57) ABSTRACT

A sprayer system having a sprayer assembly adaptable to a variety of sizes and shapes of containers. The sprayer assembly includes a dual venturi in the flow conduit to provide even pressure and consistent flow in the spray volume. A metering device is coupled to the flow conduit for accurate and reliable regulation of mixture ratios. A dip tube, coupled to the fluid conduit, is adaptable to a variety of container orifices. In addition to acting as a conduit for passage of concentrate into the sprayer assembly, the dip tube may also be used as a cutting device to open the container into which it will be inserted. By adapting to a variety of container orifices, the dip tube allows the sprayer assembly to fit to a variety of containers.

10 Claims, 7 Drawing Sheets

SPRAYER

BACKGROUND

The present invention relates generally to spraying devices, and more particularly to spraying devices adaptable to a variety of containers.

Typical lawn and garden tank sprayers that apply fertilizers, pesticides or other chemicals require a fixed dilution ratio by the addition of water thereto to provide a liquid spray mixture. There are considerable energy requirements necessary to provide adequate pressure to atomize and propel the liquid mixture into a spray. This entails manual pumping of air into a pressure chamber and building up of the pressure to a magnitude that creates an adequate spray pattern for the application, which can be manually demanding for the user. The user will also periodically pump the pressure back up to its operating pressure to re-establish the proper spray pattern, disrupting the spray process, prolonging the time it takes to complete a spray application.

Currently available garden hose-end sprayers that incorporate aspirating units, utilize a series of orifices to meter the concentrate side of the system to achieve a preset mixing ratio. For example, the popular Dial N Spray™ unit available from Scotts Miracle-Gro Company uses various orifices in a rotational disk that are calibrated and labeled so that the user only needs to set the dial to the correct setting to achieve the desired mixing ratio. Downstream pressure fluctuations, sometimes present with adjustable nozzles, can affect the metering accuracy of these aspirating units. Additionally, when back pressure is created in the spray nozzle, the venturi will not operate below atmospheric pressure, resulting in a change or actual stop in the flow. The mixture ratio is also affected. These changes in the mixture ratio will in turn affect the efficacy of the spraying application.

Furthermore, many of the sprayers on the market require premixing of the chemicals and water, exposing the user to chemicals and the potential for spilling of the chemicals during mixing. Initial opening of the concentrate bottle cap and typical foil seal can be difficult to break. The user usually uses a sharp tool to break the seal. There is a high probability that the tool will get concentrate on it when it punctures the foil. The tool and the process of opening the foil seal expose the user to accidental spillage of the concentrate. Sometimes a transfer container is used to measure the amount of concentrate, which is then transferred to the sprayer. There are exposure risks in this process associated with cleaning and storage of the transfer container. The user is required to manually measure out the recommended quantity of concentrate with a spoon, cap or other measuring device. The concentrate is then added and diluted with a known volume of water in the sprayer tank for use in the application. It is possible that the premixing and transfer process can deposit concentrate on undesirable surfaces of the sprayer resulting in yet more exposure to chemicals.

It is a primary object of an embodiment of the invention to provide a sprayer system that eliminates or reduces the user's exposure to concentrate and diluted chemicals. It is another object of an embodiment of the invention to provide a sprayer system that does not require premixing of concentrate and water. It is a further object of an embodiment of the invention to provide a sprayer system that reduces or eliminates the environmental and other problems associated with spraying of chemicals, storage of chemicals, proper disposal of chemicals and clean-up of chemicals. It is yet another object of an embodiment of the invention to provide a sprayer system that is adaptable to any type of container. It is a further object an embodiment of the invention to provide a sprayer system having an accurate and reliable metering component. It is a further object of an embodiment of the invention to provide a sprayer system that is easy to clean. It is a further object of an embodiment of the invention to provide a transparent and visual indication of the fluid movement, mixing and filtering process. It is still another object of an embodiment of the invention to provide a sprayer system that is ergonomically designed and requires little or no effort to operate. It is a further object of an embodiment of the invention to allow only clean water in the pressurized sprayer tank.

SUMMARY OF THE INVENTION

These and other objects and advantages are accomplished by a sprayer system having a sprayer assembly adaptable to a variety of sizes and shapes of containers. In one aspect of an embodiment of the present invention, the sprayer assembly includes a dual venturi in the flow conduit to provide even pressure and consistent flow in the spray volume. In another aspect of an embodiment of the invention, the sprayer assembly includes a metering plate for accurate and reliable regulation of mixture ratios. In yet another aspect of an embodiment of the invention, the sprayer assembly includes a dip tube that is adaptable to a variety of container orifices. In addition to acting as a conduit for passage of concentrate into the sprayer assembly, the dip tube may also be used as a cutting device to open the container into which it will be inserted. By adapting to a variety of container orifices, the dip tube allows the sprayer assembly to fit to a variety of container orifices. The sprayer assembly easily couples to the dip tube for adaptability to different types of containers.

BRIEF DESCRIPTION OF THE DRAWINGS

Embodiments of the present invention will be more fully understood and appreciated by reading the following Detailed Description in conjunction with the accompanying drawings, in which.

DETAILED DESCRIPTION

Figure 1:
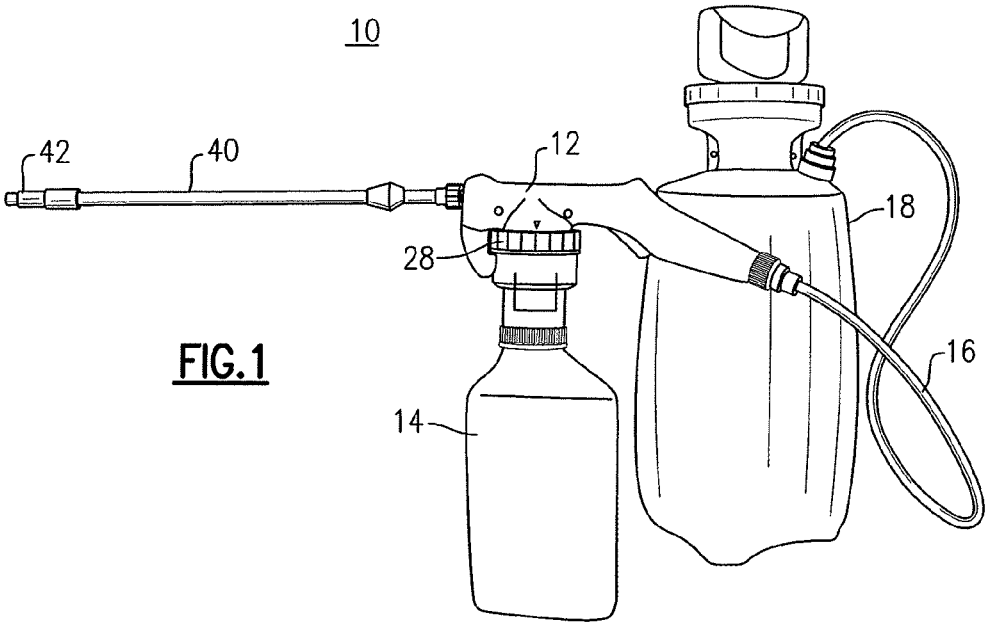
FIG. 1 is a perspective view of an embodiment of the sprayer system of the present invention.
Figure 2:
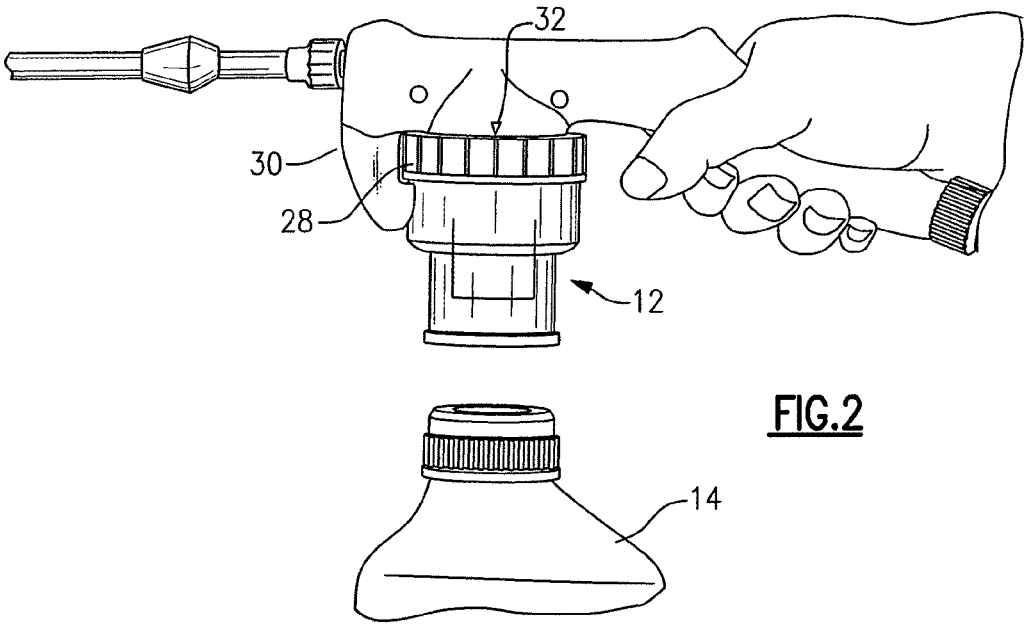
FIG. 2 is a perspective view of an embodiment of the sprayer assembly of the present invention.

As will be appreciated, an embodiment of the present invention provides a spray system 10 as shown in FIG. 1, having a spray assembly 12 for convenient adaptation to a container 14 for withdrawal, mixing and dispensing of the ingredients from container 14. Container 14 typically holds additives such as chemical or fertilizer ingredients that must be mixed with another fluid, such as water. Spray assembly 12 includes a flexible hose 16 for attachment to a fluid source, such as a water tank 18. It is understood that the fluid source may be any of a variety of structures including back pack tanks, hand portable tanks or even tractor transported tanks.

Figure 4:
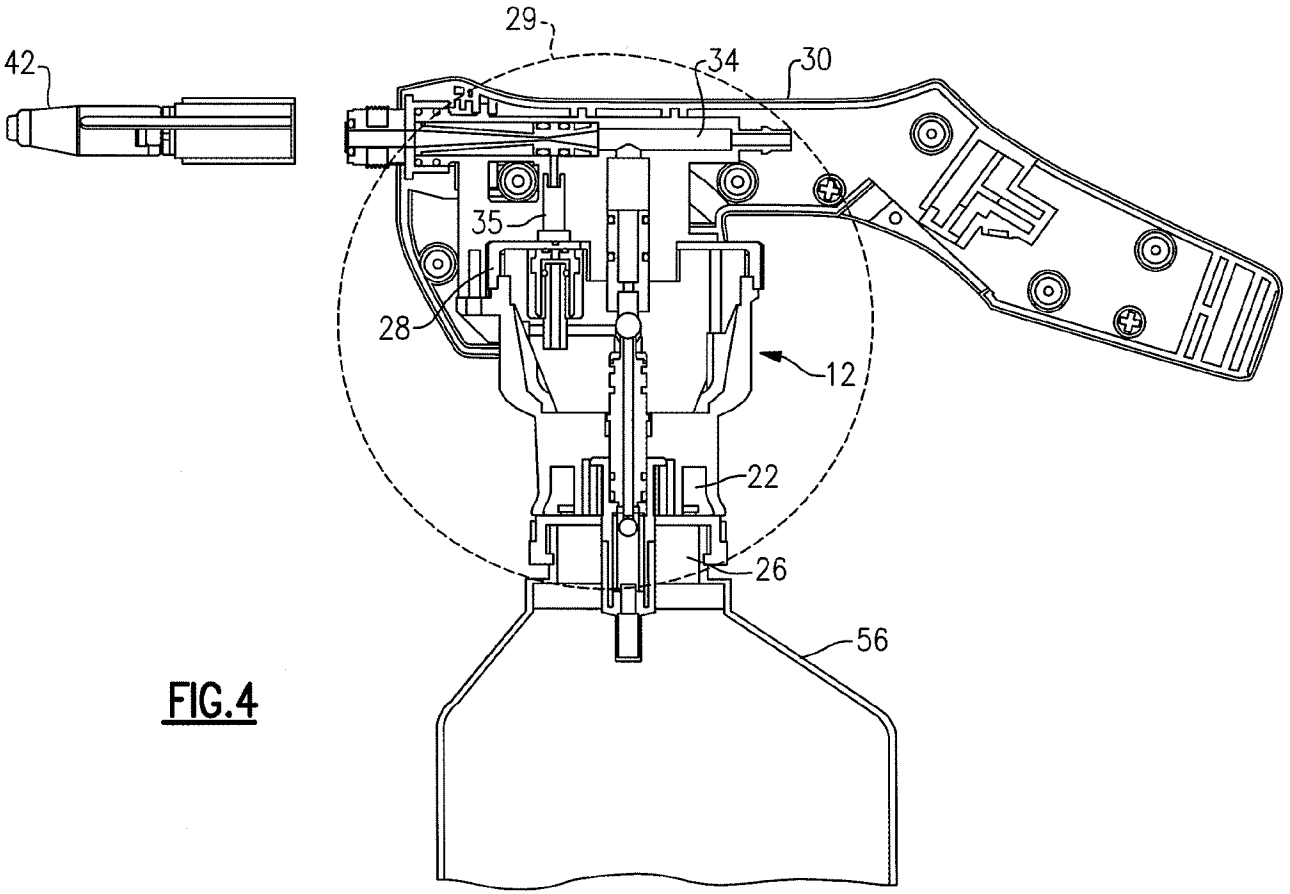
FIG. 4 is a partial cross-sectional view of an embodiment of the sprayer assembly of the present invention.
Figure 5A:
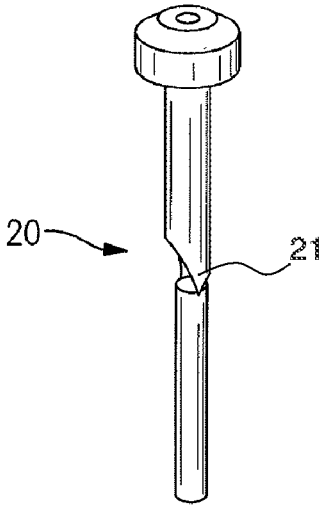
FIG. 5*a* is a perspective view of an embodiment of the dip tube of the sprayer system of the present invention.
Figure 5B:
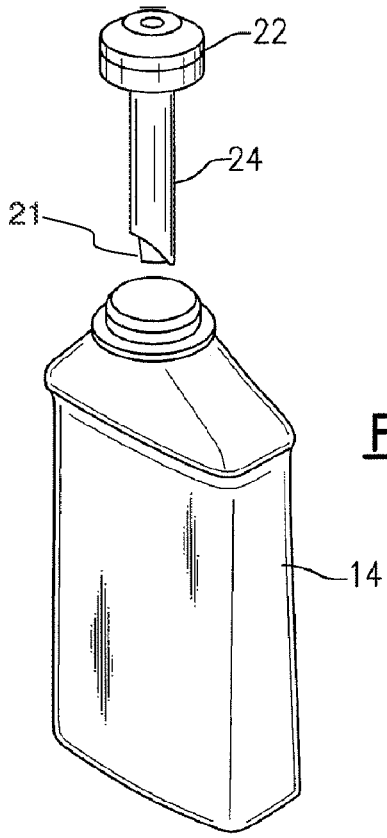
FIG. 5*b* is a perspective view of an embodiment of the dip tube and container of the sprayer system of the present invention.

Spray assembly 12 is able to cooperate with container 14 via a dip tube 20, shown in FIGS. 5*a* and 5*b*. Dip tube 20 is inserted in container 14 to draw the ingredients therethrough to spray assembly 12. Dip tube 20 includes a head portion or cap 22, a shaft 24, and a cutting component 21. Cap 22 is adjustable and can fit onto a variety sizes of container orifices to connect thereto. As shown in FIG. 4, head portion 22 of dip tube 20 is coupled to orifice 26 of container 14. A multiple number of different-sized caps 22 may be provided with dip tube 20 to provide a precise fit to container 14 or any container that needs to attach to spray assembly 12. Accordingly, dip tube 20 and cap 22 are easily switched from one container to another, allowing for the use of different chemicals for different applications, using the same spray assembly.

In a further aspect of the invention, spray assembly 12 includes a metering device 28 to provide variations in the ratio of components being mixed together. Metering device 28 is coupled to fluid conduit 29 and is located on housing 30, which housing further encases the components of spray assembly 12. The ratio of ingredients in container 14 to fluid, such as water, in tank 18, can vary from use to use, depending upon the application. Also, since the system may be used with different containers and therefore different ingredients, the different ingredients may require different mixing ratios with water. Metering device 28 addresses all of these needs by providing options for a variety of ratios including ratios of chemical concentrate to water in the range of 500:1 to 4:1. Examples of ratios that may be provided by device 28 include, but are not limited to, 0.25 concentrate: 0.75 water, 0.50 concentrate: 0.50 water, or 0.75 concentrate: 0.25 water. Device 28 is set at the preferred ratio by turning the dial to match the preferred ratio at arrow 32 positioned above device 28.

Figure 3:
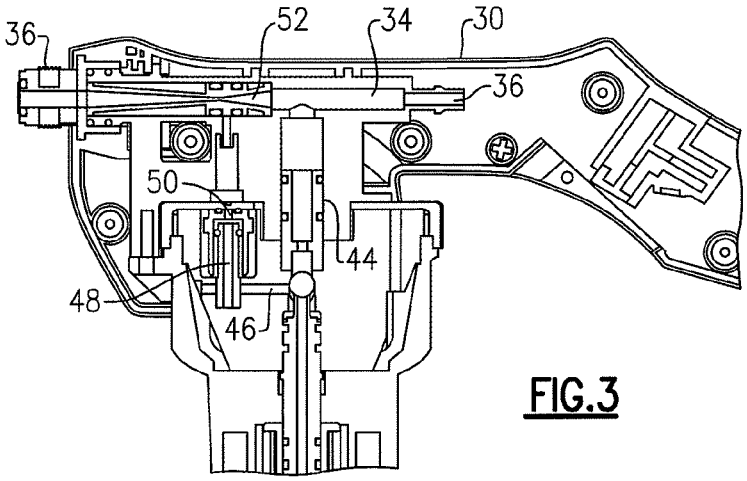
FIG. 3 is a partial cross-sectional view of an embodiment of the sprayer assembly of the present invention.
Figure 12:
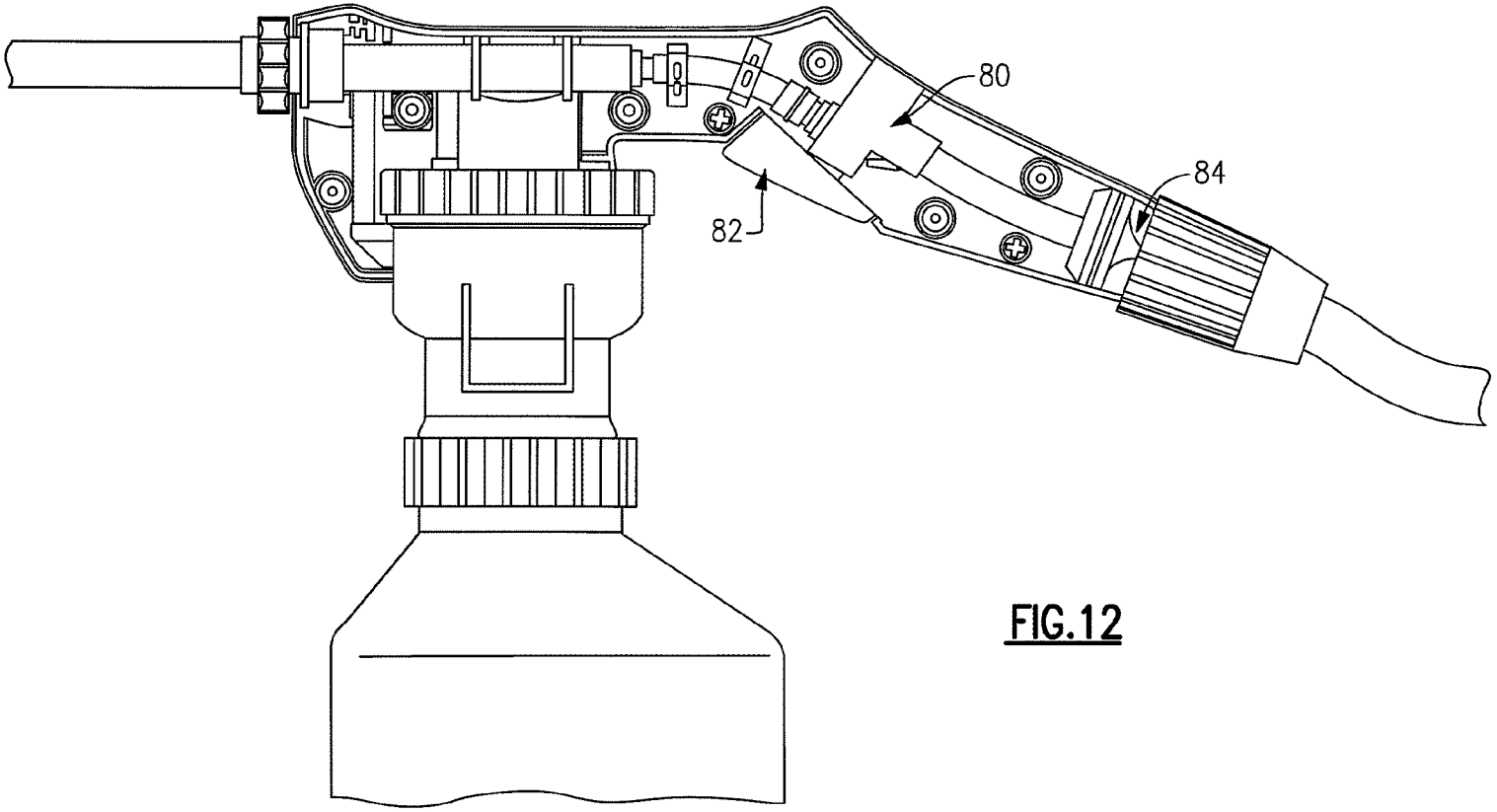
FIG. 12 is a partial perspective view of an embodiment of the sprayer assembly of the present invention.

Reference is made to FIGS. 3, 4 and 12 which show the internal components in housing 30 of sprayer assembly 12. The internal components include a fluid conduit 29, which includes all the passages in sprayer assembly 12 for the flow of fluid and concentrate therethrough. A longitudinally extending passageway 34 is coupled to flexible hose 16 (shown in FIG. 1) at the inlet side 36 of passageway 34 and continues to outlet 38. A shut-off valve 80 is linked to passageway 34 and flexible hose 16 and connected to trigger 82. As trigger 82 is pressed, water is allowed to flow through passageway 34. By releasing trigger 82, shut-off valve 80 blocks water from flowing through to passageway 34. This protects hose 16 and container 18. A filter 84 may be positioned proximate the fluid entrance end in housing 30 and may be easily cleaned as needed.

Outlet 38 can be connected to a long shaft 40, which is further connected to a spray nozzle tip 42, as shown in FIG. 1. Passageway 34 is also connected to passageway 44, which is positioned perpendicular to passageway 34. Passageway 44 is further connected to passageway 46, which runs perpendicular to passageway 44 and parallel to passageway 34. Passageway 46 connects to passageway 48, which is connected to passageway 34, to complete the loop. Passageway 46 also connects to passageway 34 via passageway 50. A check valve 35 is positioned above passageway 50 to protect container 14 from any backflow of fluid. One venturi 52 is positioned within passageway 34 and another venturi 54 is positioned within passageway 46. The venturi effect created by the dual venturi pulls concentrate from container 14 to mix with water in the fluid conduit 29. The dual venturi arrangement provides a high pressure spray resulting in an even and continuous spray volume.

Figure 7:
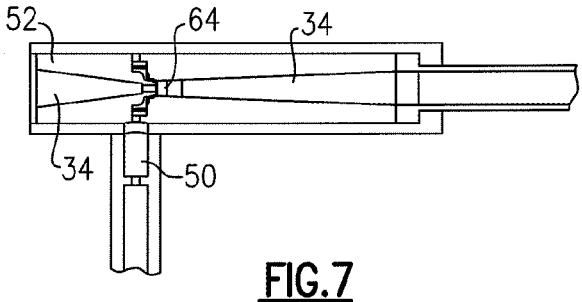
FIG. 7 is a fragmented view of an embodiment of the spray assembly of the present invention showing the venturi.
Figure 8:
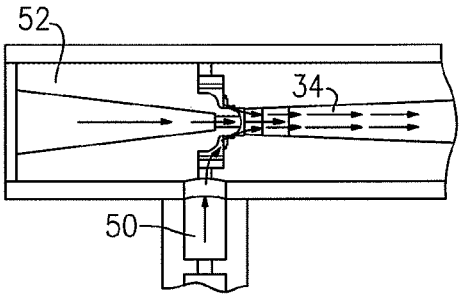
FIG. 8 is a fragmented view of an embodiment of the spray assembly of the present invention showing the venturi.
Figure 6:
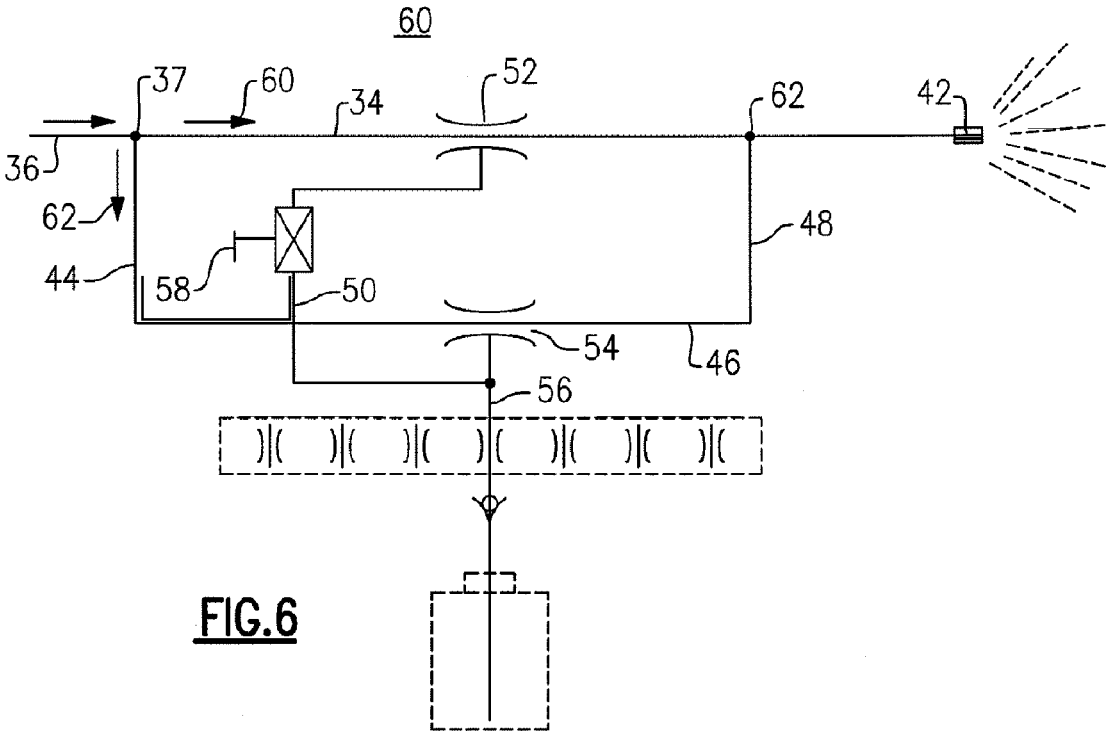
FIG. 6 is an embodiment of a metering circuit diagram of the fluid flow pattern through the sprayer system of the present invention.

It should be mentioned that in the discussion that follows, FIGS. 6 through 8 are mirror images of FIGS. 1 through 4 with respect to the conduit circuit and the fluid flow. The fluid flow in FIGS. 1 through 4 is from right to left and the fluid flow in FIGS. 6 through 8 is from left to right.

Reference is made to FIG. 6, which shows dual venturi circuit 60 of the present invention and clearly illustrates the flow pattern of the mix (concentrate and water) through spray system 10. A main venturi 54 is located in passageway 46 and a secondary venturi 52 is located in passageway 34. Concentrate from container 14 is pulled upward through dip tube 20 to passageway 56. A shutoff valve 58 is located in passageway 50. If shutoff valve 58 is open, concentrate can flow through two pathways. That is, it can flow through both passageway 46 to spray nozzle 42 and passageway 50 to passageway 34 to spray nozzle 42.

Water enters through flexible hose 16 at inlet 36 and is directed into two separate pathways at point 37. It flows down passageway 44 as shown by arrow 62. From passageway 44 it moves into and through passageway 54 and through main venturi 54, mixing with concentrate at venturi 54, which mixture continues up passageway 48 through passageway 34 to spray nozzle 42. The second pathway the water stream follows is in passageway 34. If shut off valve 58 is open, concentrate moves up passageway 50 and mixes with water in passageway 34 at the second venturi 52. This water/concentrate stream meets the first water/concentrate mixture at point 62 and the mixtures flow together out through nozzle 42. If shut off valve 58 is closed, only water flows through passageway 34, adding to the water/concentrate mixture at point 62, and flowing out through spray nozzle 42. Accordingly, depending upon the volume of water necessary in the mixture, if more water is needed, the shut-off valve is closed and if less water is needed, the shut-off valve is left open. Shut-off valve 58 is controlled by metering device 28.

Reference is made to FIGS. 7 and 8, which show venturi 52 in passageway 34. Concentrate moves up passageway 50 and enters the venturi throat, at which point it mixes with water in passageway 34. This venturi design has an optimal throat diameter for the range of flow rates and mixture ratios used in this spray assembly 12. This venturi allows for more energy efficiency mixing of the water and the concentrate because both are flowing in the same direction.

The tuning of the size and flow characteristics of the spray nozzle and the venturi are very critical for achieving the proper atomization and spray patterns for lawn and garden applications. The spray nozzles used in garden sprayers are designed to work within their typical operating pressures. In the venturi design, there is a pressure loss downstream of the venturi throat due to the friction losses from geometry changes in the flow path and the mixing of different velocity streams in the throat. The spray nozzle is designed to have a flow coefficient in the range of from about 0.2 to about 0.4 gallons per minute and to provide a droplet size in the range from about 200 to 600 microns with adequate pattern shape and distribution. The spray nozzle design also has different spraying modes that have the same flow coefficient. This nozzle design provides the correct fluid pressure distribution and flow rates to allow the correct mixture ratios over the operating pressure range and different nozzle settings.

Figure 9:
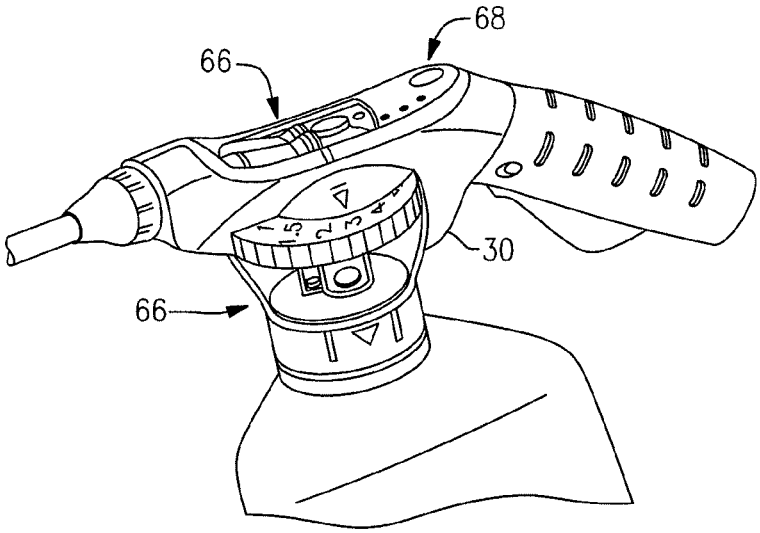
FIG. 9 is a partial perspective view of an embodiment of the sprayer assembly of the present invention.

In another aspect of the invention, reference is made to FIG. 9, which illustrates details of housing 30. Housing 30 may be fabricated of any suitable material that is resistant to and compatible with the chemical fluid to be sprayed. Examples include, but are not limited to, different types of polymeric materials such as polyethylene and polypropylene, and metal, such as stainless steel. In the preferred embodiment, the housing 30 and other fluid components are fabricated of clarified polypropylene to allow the user to view chemical fluid as it passes through the system to determine when fluids are mixing. Sections 66 on housing 30 are transparent or translucent to allow the user to view the fluid passing through the system. Housing 30 may be entirely clear throughout or in only specific sections, as shown in FIG. 9. A flow indicator 68 also may be included on housing 30 to indicate whether the system is functioning as required.

Figure 10:
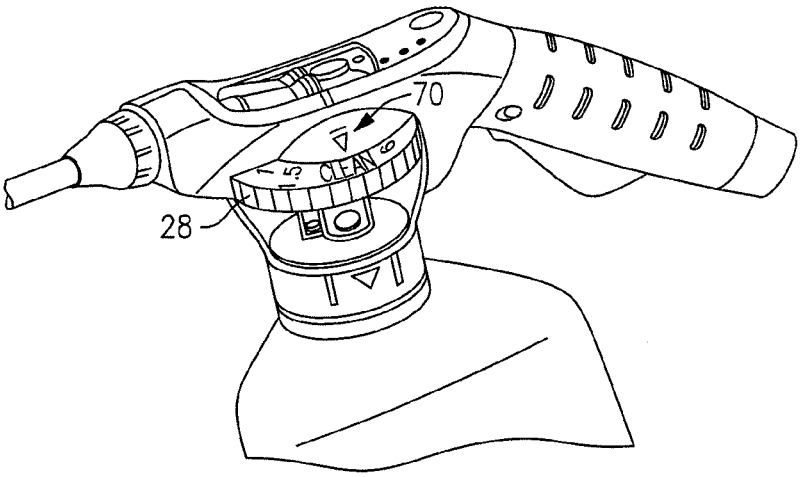
FIG. 10 is a partial perspective view of an embodiment of the sprayer assembly of the present invention.

In a further aspect of the invention, sprayer assembly 12 may include a self cleaning cycle as a spray option on metering device 28. As illustrated in FIG. 10, a CLEAN cycle 70 is included on metering device 28. This self cleaning option flushes water through sprayer assembly 12 removing all traces of chemicals in the fluid conduit 29, shaft 40 and spray nozzle 42. This prevents aggregation and clogging of particles in nozzle 42 and fluid conduit 29 and allows the user to clean sprayer assembly 12 without having to remove spray assembly before cleaning has occurred. This further eliminates or reduces the user's exposure to chemicals.

Figure 11:
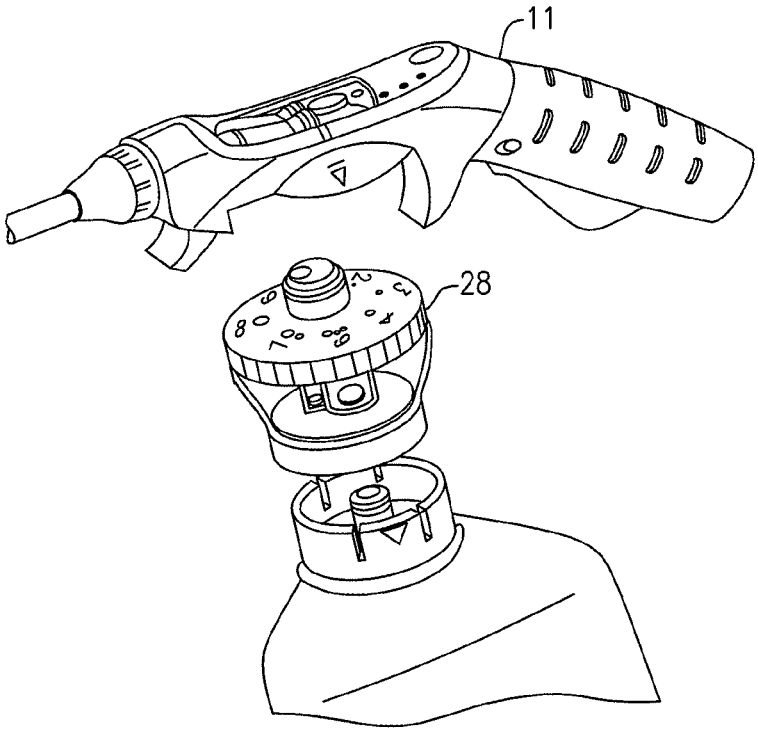
FIG. 11 is a partial perspective view of an embodiment of the sprayer assembly of the present invention.

As an another option, spray assembly 12 may be easily disassembled for cleaning. FIG. 11 shows sprayer 11 and metering device 28 as separate components, which easily disconnect, if further cleaning is necessary.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended embodiments.

What is claimed is:

1. A sprayer system comprising:

a container having an additive therein;

a dip tube for insertion in the container;

a spray nozzle;

a sprayer device having a housing and a fluid conduit disposed in the housing and being coupled to the dip tube, wherein the fluid conduit includes a check valve and a dual venturi in parallel, said sprayer device further having a first inlet, a second inlet, and an outlet, wherein the first inlet is connected to a flexible hose, the second inlet is connected to the dip tube, and the outlet is connected to said spray nozzle;

the flexible hose having a first end and a second end, wherein the first end is connected to the sprayer device and the second end is connected to a fluid source having fluid therein;

a metering device coupled to the fluid conduit to vary the ratio of fluid to additive;

wherein the fluid conduit comprises a first passageway connecting the first inlet to the outlet, and a second passageway connecting the second inlet to the outlet, and wherein the dual venturi comprises a first venturi in the first passageway and a second venturi in the second passageway; and wherein the fluid and the additive are mixed in the fluid conduit and expressed from the outlet through the spray nozzle.

2. The sprayer system of claim 1 wherein the first venturi and the second venturi are disposed in parallel relationship to one another.

3. The sprayer system of claim 2 wherein the fluid conduit comprises a third passageway connecting the second inlet to the first venturi, wherein a shut off valve is located in the third passageway.

4. The sprayer system of claim 3 wherein the shut off valve is linked to the metering device.

5. The sprayer system of claim 4 wherein the housing of the sprayer device is fabricated of a transparent or translucent material.

6. The sprayer system of claim 5 where the housing of the sprayer device comprises a flow indicator.

7. The sprayer system of claim 6 wherein the sprayer device comprises a self-cleaning cycle.

8. The sprayer system of claim 7 wherein the sprayer device is comprises two or more parts that disconnect.

9. The sprayer system of claim 8 wherein the fluid source is located in a pressurized tank.

10. The sprayer system of claim 9 wherein the fluid from said fluid source comprises solely water.

* * * * *